United States Patent [19]

Donofrio

[11] 4,157,108

[45] Jun. 5, 1979

[54] SHADE ROLLER ASSEMBLY

[75] Inventor: John D. Donofrio, Ogdensburg, N.Y.

[73] Assignee: Joanna Western Mills Company, Chicago, Ill.

[21] Appl. No.: 723,781

[22] Filed: Sep. 16, 1976

[51] Int. Cl.[2] ..... A47G 5/02

[52] U.S. Cl. ..... 160/263; 160/323 R

[58] Field of Search ..... 160/250, 263, 323 R, 160/324, 325, 326, 389, 385, 387; 403/2, 104, 109, 41, 164, 165; 248/DIG. 9; 284/3, 4; 93/16, 15, 81 R, 94 R; 29/413; 225/96.5

[56] References Cited

U.S. PATENT DOCUMENTS

| | | | |
|---|---|---|---|
| 913,366 | 2/1909 | Donnelly | 285/4 |
| 3,211,212 | 10/1965 | Smith | 160/325 |
| 3,218,771 | 11/1965 | Horn | 52/98 |
| 3,308,874 | 3/1967 | Anderson | 160/326 |
| 3,315,728 | 4/1967 | Anderson et al. | 160/326 |
| 3,422,584 | 1/1969 | Howard | 52/98 |
| 3,679,109 | 7/1972 | King, Jr. | 225/96.5 |
| 3,864,030 | 11/1974 | Katt | 285/4 |
| 3,908,208 | 9/1975 | McIlroy | 285/4 |

*Primary Examiner*—Peter M. Caun
*Attorney, Agent, or Firm*—Bean, Kauffman & Bean

[57] ABSTRACT

A shade roller assembly features a roller having a tubular end portion formed with a plurality of circumferentially extending lines of weakness serving to define a plurality of ring elements, which may be selectively torn from the tubular end portion when desired to decrease the overall length of the assembly.

8 Claims, 10 Drawing Figures

Fig. 1.
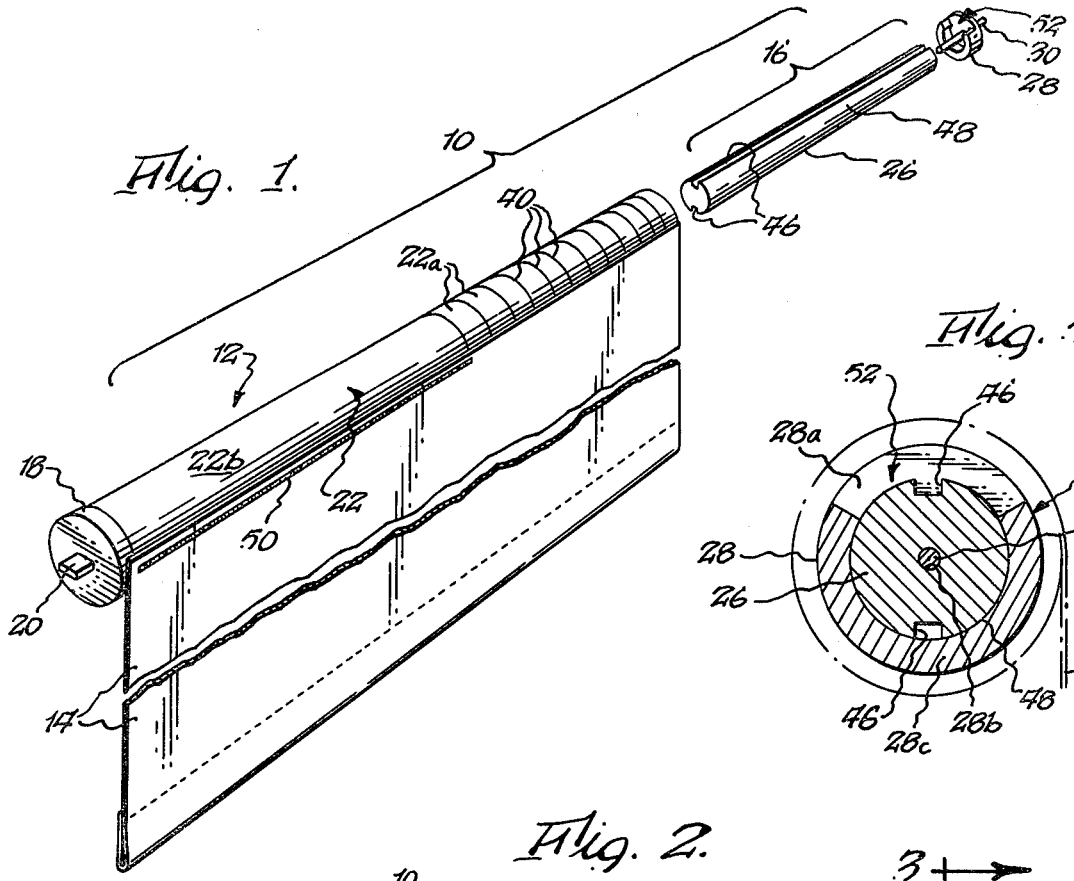
Fig. 5.
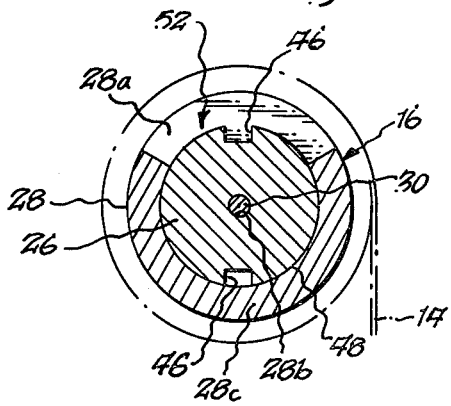
Fig. 2.
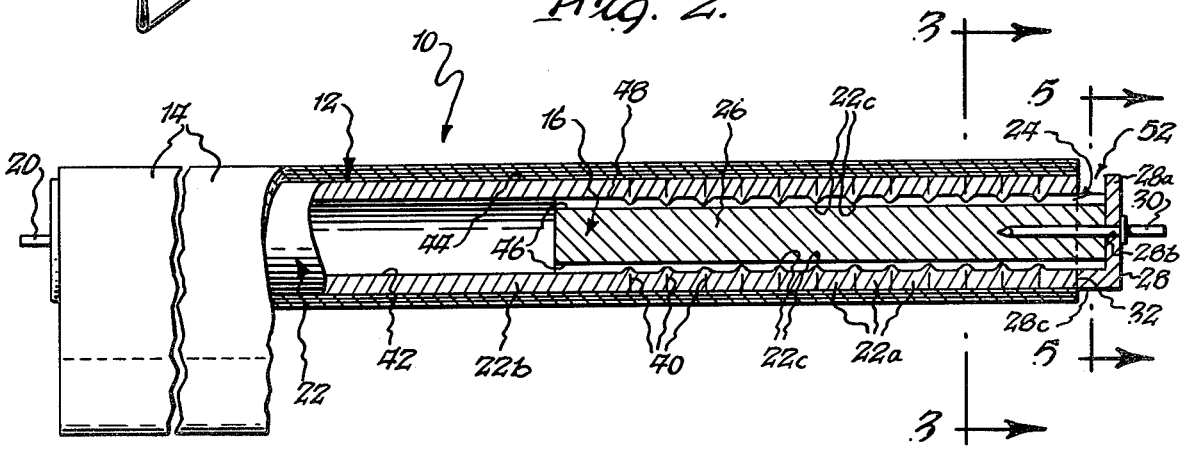
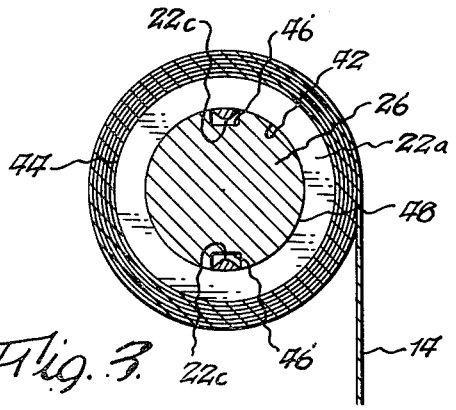
Fig. 3.
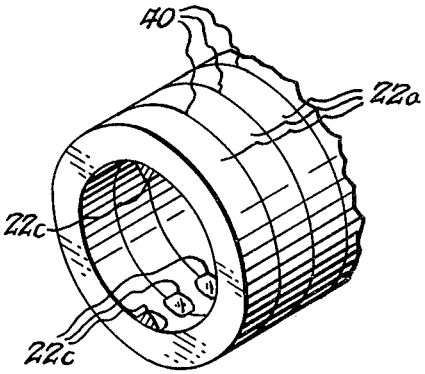
Fig. 4.

10
10'
14
14a
16
16'
18
22a
26
26'
28

SHADE ROLLER ASSEMBLY

BACKGROUND OF THE INVENTION

Window shade rollers are produced in several standard lengths, which are chosen to fit those windows having the most frequently encountered widths. Unfortunately, however, a great number of windows are not standard in width and even particular windows which are nominally of a standard width often vary from the "standard" dimensions. Consequently, it is often necessary to adjust the length of the roller upon which the shade is wound to the actual width of each particular window. This must be done reasonably accurately, or else the roller will not fit its supporting brackets, or the shade may appear to be displaced relative to the window.

The adjustment in the length of the roller to suit individual windows cannot be done at the factory, and accordingly must be done by either the dealer or the customer. The standard practice is to select the next larger standard size of shade and remove an end of both the shade and its roller as required to achieve the desired dimension. For this purpose, the dealers are normally equipped with special machines which neatly trim the shade and the end of its roller. Due to errors in measurement and in the trimming process, the trimmed roller is often incorrectly cut to size.

In view of the drawbacks of the standard "trimming" practice, various attempts have been made to devise customer or user adjustable length shade rollers. These prior attempts have primarily employed the use of various types of telescopic rollers. However, it has also been proposed to provide a plurality of sleeve devices which may be added to or removed from the roller, as required to increase or decrease its overall length, as evidenced for instance by U.S. Pat. No. 3,308,874.

SUMMARY OF THE INVENTION

The present invention is directed towards an improved shade roller construction and method of forming same, which allows a customer or user to incrementally reduce the length of a standard length shade roller as required to accommodate same to a non-standard width window.

The invention contemplates forming a tubular end portion of the shade roller with one or more ring elements joined to the tubular end portion and to each other by tear elements and providing a gudgeon pin mounting plug, which is removably insertable within the tubular end portion for alternately reinforcing-/mounting same and providing a tool for use in tearing ring elements from the tubular end portion, as required to reduce the overall length of the shade roller.

In a preferred form of the invention, the ring elements and the tear strips are formed integrally with the tubular end portion, which may be in the form of a paper wound tube. More specifically, the gudgeon pin mounting plug is formed with one or more axially extending surface recesses and used as a mandrel during the ring element cutting or forming operation. Incident to cutting of the ring elements, a portion of the inner surface of the tubular end portion is forced radially inwardly to reside within the plug recesses, whereby to define tear elements which serve to interconnect the ring elements and the nonsevered or adjacent portion of the tubular end portion. During subsequent assembly, the shade is fixed to the non-severed portion of the tubular end portion and when subsequently wound about the roller serves to bridge across and conceal the junctures between adjacent ring elements.

When a user desires to shorten the length of the assembly, the plug may be withdrawn from the tubular end portion and then partially reinserted for use as a tool in tearing or breaking off that number of ring elements whose total length corresponds essentially to the amount of desired reduction in the length of the assembly. After removal of the ring elements and the corresponding portion of the shade, the plug is again fully inserted within the tubular end portion to complete the shortened shade roller assembly.

DRAWINGS

FIG. 1 is a perspective, exploded view of a shade roller assembly formed in accordance with the present invention;

FIG. 2 is a partial sectional view taken lengthwise through the present shade roller assembly;

FIG. 3 is a sectional view taken generally along the line 3—3 in FIG. 2;

FIG. 4 is a fragmentary perspective view showing a plurality of interconnected ring elements;

FIG. 5 is a sectional view taken generally along the line 5—5 of FIG. 2; and FIGS. *6a–6e* are views illustrating various steps employed by a customer in shortening of the roller assembly.

DETAILED DESCRIPTION

Figures 6A, 6B, 6C, 6D, 6E:
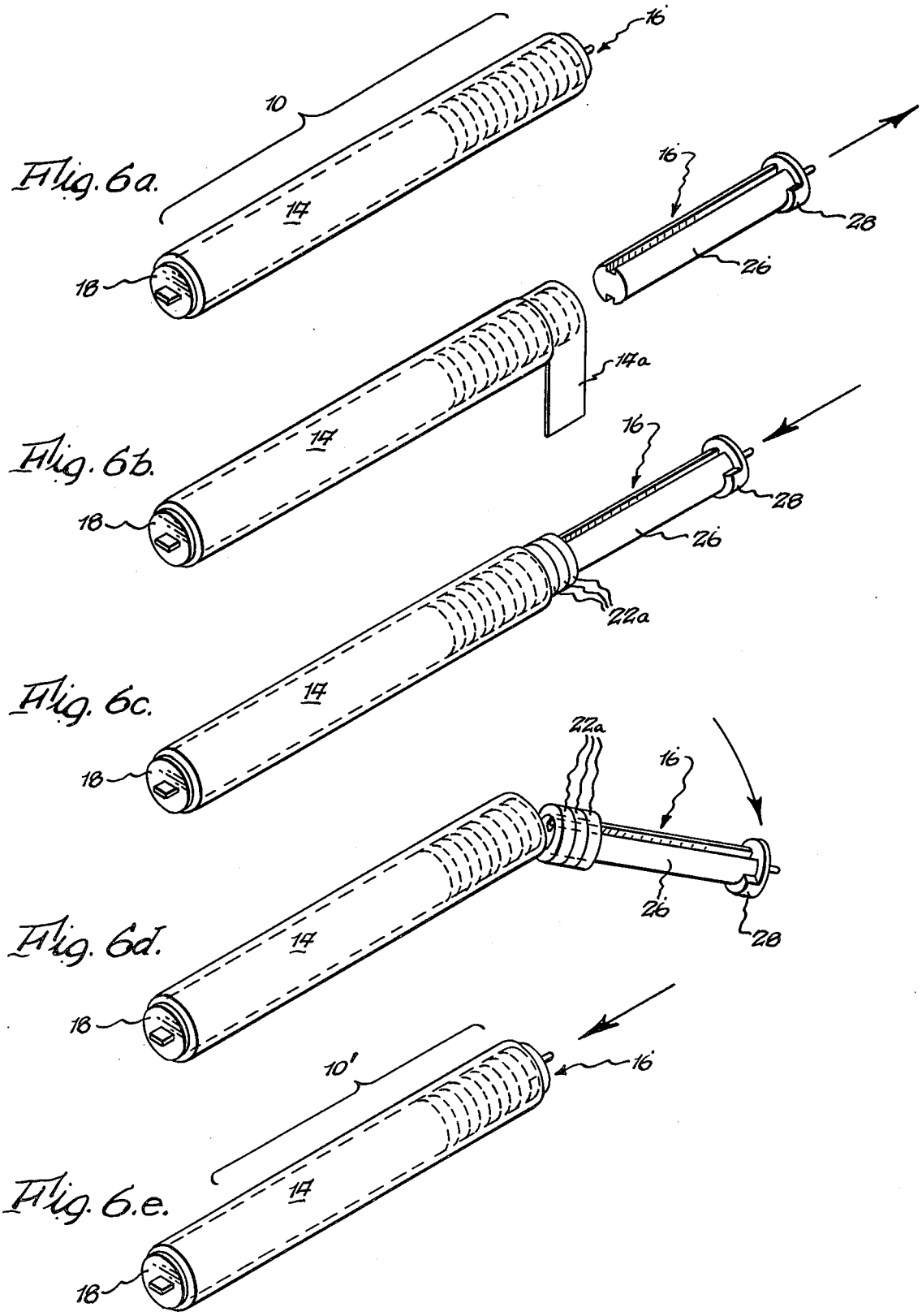

Reference is now made more specifically to FIGS. 1 and 2 of the drawings, wherein a shade roller assembly formed in accordance with the present invention is designated as 10 and shown as generally comprising a roller 12, a shade 14 adapted to be rolled upon roller 12, and an assembly mounting plug 16.

Roller 12 is of conventional construction from the standpoint that it includes a mounting cap or end portion 18 having a spear 20 and a hollow tubular end portion 22 formed with an end opening 24. It will be understood that roller 12 would also include a conventional spring or like motor, not shown, arranged within the closed end of tubular end portion 22 in a driving relationship with spear 20.

Plug 16 is also of conventional construction from the standpoint that it generally includes a generally cylindrical body portion 26, which is sized to be inserted into tubular end portion 22 through end opening 24; and means in the form of a cap 28, which is suitably attached to body portion 26, as by a gudgeon pin 30, and operative to engage with the end surface 32 of tubular end portion 22 for the purpose of limiting the length of body portion 26 inserted thereinto. Body portion 26 and cap 28 would preferably be separately formed of wood and a suitable plastic material, respectively, but of course other conventional materials could be employed in forming these parts as either separate or integral parts, as desired.

In accordance with the present invention, tubular end portion 22 is provided with at least one end preferably a plurality of suitably defined, circumferentially extending and essentially parallel lines of weakness 40, which serve to define one or more ring elements *22a* removably joined one to another and to an adjacent or non-weakened portion *22b* of the tubular end portion by one or more tear elements *22c* extending across each line of weakness. The innermost one of the lines of weakness 40 would be spaced from end surface 32 through a distance less than the inserted length of body portion 26, such that the inserted end of the latter is arranged in radial alignment with adjacent portion 22*b* and cooperate with the tear elements 22*c* to strengthen or rigidify the weakened free end of the tubular end portion, during shipment, storage and use of assembly 10. It will be understood that the purpose of this construction is to divide the free end of tubular end portion 22 into relatively small segments, which a customer may tear or otherwise sever from roller 12 with the aid of plug 16 in the manner to be described, as required to reduce the overall length of a standard size shade roller assembly to fit a non-standard size window. The axial lengths of the respective ring elements are a matter of choice and/or manufacturing convenience, but it would be preferable to form the ring elements of some given or uniform length, which may for instance vary between about one-half and one-eighth inches, as desired.

In accordance with a preferred form of the present invention, lines of weakness 40 are in the form of equally spaced apart annularly cuts or slits, which extend at least essentially between inner and outer surfaces 42 and 44 of tubular end portion 22, respectively, and tear elements 22*c* are formed integrally with ring elements 22*a* and adjacent portion 22*b* and arranged to project radially inwardly of inner surface 42 for receipt within at least one recess 46 opening through the otherwise cylindrical outer surface 48 of plug body portion 26. In the illustrated construction, plug body portion 26 is formed with two recesses 46, which extend axially thereof, and two diametrically opposite tear elements 22*c* are employed to interconnect each of ring elements 22*a* and the innermost of such ring elements to adjacent portion 22*b*, such that the tear elements received in the respective recesses are aligned in a direction extending axially of tubular end portion 22. It will be understood that tear elements 22*c* and recesses 46 cooperate to interlock tubular end portion 22 and plug 16 against relative rotation during use of assembly 10, and thus avoid the necessity of providing extremely close fitting or frictional interlock between these members, as normally is required in conventional shade roller assembly constructions.

A preferred mode of fabricating tubular end portion 22 contemplates fabricating the tubular end portion from a convolutely wound paper tube and employing plug body portion 26 or a comparably shaped mandrel to support the free end of the wound tube for rotation while in engagement with a gang of knives, not shown, whereby to define lines of weakness 40 in the form of annular cuts or slits. The knives are intended to bottom out on plug body portion outer surface 48, and in doing so cause portions of the paper tube material radially aligned with the cuts to be physically pushed or forced into recesses 46 in order to define tear elements 22*c*, which are not cut through. Thus, although the lines of weakness 40 are in the form of annular cuts extending between surfaces 42 and 44, ring elements 22*a* remain connected to each other and adjacent portion 22*b* by tear elements 22*c*.

Alternately, lines of weakness 40 could be discontinuous circumferentially of tubular end portion 22, such that the tear elements 22*c* would extend radially intermediate the inner and outer surfaces 42 and 44, or such lines of weakness merely be in the form of annular cuts which do not extend completely between such inner and outer surfaces, such that each tear element is in the form of an annularly extending portion of the inner wall of the tubular end portion. It is also contemplated that the tubular end portion could be formed of a plastic or other mold formable material and the lines of weakness and tear elements formed incident to a mold forming operation. Further, it would be possible to completely sever ring elements 22*a* from each other and the adjacent portion 22*b* or to separately form such ring elements and then removably interconnect same to each other and the adjacent portion by bonding a sleeve or one or more strips of suitable material thereto, such that portions of such sleeve or strips, which bridge the gaps between adjacent ring elements and between the innermost ring element and adjacent portion of the tubular end portion serve to define the tear elements. Also, such sleeve or strips may be applied to a tubular end portion formed in accordance with the above described preferred form of the present invention, if desired to afford greater rigidity to roller 12.

After fabrication of tubular end portion 22 in the manner described above, assembly 10 would be completed by suitably attaching shade 14 to tubular end portion 22, such as by a line of adhesive 50 extending coextensively with adjacent portion 22*b*, and then wrapping shade 14 upon roller 12. Preferably, the width of shade 14 would be such that it extends coextensively with tubular end portion 22 and conceals all of lines of weakness 40, as best shown in FIG. 2.

Now making specific reference to FIGS. 1, 2 and 5, it will be understood that the present invention additionally contemplates forming plug cap 28 with a circular base portion 28*a*, which is formed with a centrally located aperture 28*b* for receiving gudgeon pin 30 and sized to be essentially radially coextensive with tubular end portion 22. Cap 28 is also formed with a skirt portion 28*c*, which is formed integrally with base portion 28*a* and arranged to extend axially from adjacent the rim thereof. As best shown in FIGS. 2 and 5, skirt portion 28*c* is internally dimensioned to slidably receive the outer end of plug body portion 26 and is discontinuous circumferentially of the rim of base portion 28*a*, such that it cooperates with base portion 28*a* and the outer end of plug body portion 26 to define a "pull" recess 52 sized to receive the finger of a user of assembly 10 in order to facilitate selective user withdrawal of plug 16 from within tubular end portion 22.

Reference is now made to FIGS. 6*a*–6*e*, which illustrate the steps employed by a customer in selectively shortening the shade roller assembly 10. In this regard, FIG. 6*a* illustrates assembly 10 of a standard length and in a fully assembled condition, such as it would be purchased by a user. A purchaser would thereafter adjust or reduce the overall length of assembly 10 by first measuring the width of a non-standard width window with which assembly 10 is to be used and then mark shade 14, as by means of a pencil, to indicate the amount or width of excess shade material to be removed. As indicated in FIGS. 6*b* and 6*c*, the excess shade material would then be cut or otherwise severed and removed as a strip 14*a* then adjacent the free end of tubular body portion 22 to expose those of ring elements 22*a*, which lie in radial alignment therewith, without unwinding the remainder of shade 14 from the roller. The user, either before or after removal of strip 14*a*, would remove plug 16 and use the previously formed pencil mark or the width of strip 14*a* removed to indicate the proximate length of plug body portion 26 to be reinserted into tubular end portion in the manner indicated in FIG. 6*c*.

The user would then employ plug 16 as a tool or lever to break off or remove from the tubular end portion that number of ring elements 22*a*, which were previously exposed by the unwinding of strip 14*a*, as indicated generally in FIG. 6*d*. The thus broken off ring elements would then be removed from plug 16 and the plug again fully inserted within the tubular end portion to complete a shortened shade roller assembly 10'.

As a practical matter, the mark made by a user preliminary to removing strip 14*a* will normally not coincide with one of lines of weakness 40 and thus a portion of the outer surface of a ring element adjacent to the ones removed in the manner indicated in FIG. 6*d* will remain exposed to view. This would normally not be objectionable, however, particularly when the axial length of the ring elements are not excessive and/or the coloration of their exposed surfaces corresponds to that of plug 16.

While the construction of the present shade roller assembly is particularly adapted to facilitate shortening of the length of standard width shade rollers in the home by a user, it will of course be understood that the present assembly is also adapted to be machine trimmed by a dealer, if a user should so desire.

I claim:

1. In a shade roller assembly of the type having a roller formed with an assembly mounting end portion and an opposite hollow, tubular end portion having an end opening, a shade rolled upon said roller, and an assembly mounting plug removably insertable into said tubular end portion through said opening and including means for limiting the amount of insertion of said plug; the improvement for facilitating adjustment of the length of said assembly, which comprises in combination:

said tubular end portion having at least one line of weakness extending circumferentially thereof to define at least one ring element, said ring element being connected to an adjacent portion of said tubular end portion by at least one tear element, said tear element being severable to permit removal of said ring element from said tubular end portion to effect shortening of said assembly by an amount corresponding to the axial dimension of said ring element so removed, said line of weakness being arranged for concealment by said shade when wound on said roller;

said plug being axially dimensioned to extend inwardly of said opening beyond said line of weakness, whereby an inserted end of said plug normally resides in radial alignment with said adjacent portion of said tubular end portion; and said plug also including a generally cylindrical body portion and a cap fixed to an outer end of said body portion by a gudgeon pin, said cap including a base portion centrally apertured to receive said pin and being sized to be essentially radially co-extensive with said tubular end portion and an integrally formed skirt portion extending axially from adjacent a rim of said base portion, said skirt portion being internally dimensioned to slidably receive said outer end of said body portion and being discontinuous circumferentially of said rim of said base portion, whereby to cooperate with said base portion and said outer end of said body portion to define a "pull" recess sized to receive a finger of a user of said shade roller assembly to facilitate selective user withdrawal of said plug from within said tubular end portion.

2. The improvement according to claim 1, wherein said tear element is formed integrally with said ring element and said adjacent portion.

3. The improvement according to claim 1 wherein said tubular end portion is formed with a plurality of circumferentially extending lines of weakness arranged to define a plurality of ring elements of essentially uniform axial dimension, and wherein adjacent ones of said ring elements are removably connected by at least one tear element, said lines of weakness comprising circumferentially extending cuts extending over more than one half of the circumference of said tubular end portion and extending radially through said tubular end portion.

4. The improvement according to claim 3, wherein tear elements connecting said adjacent ones of ring elements and said tear element connecting to said adjacent portion of said tubular end portion are integral with said ring elements and said adjacent portion of said tubular end portion.

5. The improvement according to claim 1, wherein said plug is formed with at least one surface recess arranged to extend axially thereof, and said tear element projects radially inwardly of an inner surface of said tubular end portion for receipt within said surface recess.

6. The improvement according to claim 5, wherein said line of weakness is an annular slit extending radially between said inner surface of said tubular end portion and an outer surface thereof.

7. The improvement according to claim 6, wherein said tubular end portion is formed with a plurality of annular slits arranged to define a plurality of end-to-end disposed ring elements of essentially uniform axial dimension, adjacent ones of said ring elements being connected by at least one tear element, tear elements connecting said adjacent ones of said ring elements and said tear element connected to said adjacent portion of said tubular end portion being arranged in alignment axially of said tubular portion for receipt within said surface recess, and the tear elements are formed integrally with said ring elements and said adjacent portion of said tubular end portion.

8. In a method of forming an adjustable length window shade roller assembly of the type having a roller formed with an assembly mounting end portion and an opposite hollow tubular end portion having an end opening, a shade rolled upon said roller, and an assembly mounting plug removably insertable into said tubular end portion through said end opening and including means for limiting the amount of insertion of said plug into said tubular end portion, the steps including in combination:

forming the surface of an insertable portion of said plug with an axially extending recess, inserting said plug into said tubular end portion through said end opening, forming a plurality of parallel, circumferentially extending cuts in said tubular end portion at least essentially extending between inner and outer surfaces thereof to define a plurality of ring elements having a relatively uniform axial length while simultaneously forcing portions of said tubular end portion aligned with said cuts radially inwardly of said inner surface and into said recess, whereby to define tear elements severably interconnecting said ring elements one to another and to an adjacent non-cut portion of said tubular end portion, and innermost one of said cuts being spaced from said end opening of said tubular end portion through a distance less than the inserted length of said plug, attaching said shade to at least said non-cut portion of said tubular end portion and wrapping said shade about said roller to bridge across and conceal said cuts.

* * * * *